US007083479B2

(12) United States Patent
Muller et al.

(10) Patent No.: US 7,083,479 B2
(45) Date of Patent: Aug. 1, 2006

(54) FASTENER FOR AN ELECTRIC CONTACT

(75) Inventors: Manfred Muller, Huttenberg (DE); Eckhard Blank, Wolfsburg (DE); Roland Kurz, Linden (DE)

(73) Assignee: Newfrey LLC, Newark, DE (US)

( * ) Notice: Subject to any disclaimer, the term of this patent is extended or adjusted under 35 U.S.C. 154(b) by 0 days.

(21) Appl. No.: 10/641,725

(22) Filed: Aug. 15, 2003

(65) Prior Publication Data

US 2004/0149481 A1 Aug. 5, 2004

Related U.S. Application Data

(63) Continuation of application No. PCT/DE02/00490, filed on Feb. 12, 2002.

(30) Foreign Application Priority Data

Feb. 16, 2001 (DE) ..... 101 07 231

(51) Int. Cl.
*H01R 4/30* (2006.01)

(52) U.S. Cl. ..... 439/801

(58) Field of Classification Search ..... 439/801, 439/63, 573, 809, 806, 766, 80, 833, 108, 439/92; 296/194; 411/427, 535
See application file for complete search history.

(56) References Cited

U.S. PATENT DOCUMENTS

| | | | |
|---|---|---|---|
| 2,144,350 | A | 1/1939 | Swanstrom |
| 2,144,553 | A | 1/1939 | Simmonds |
| 2,167,285 | A | 7/1939 | Smith |
| 2,237,595 | A | 4/1941 | Dyer |
| 2,299,158 | A | 10/1942 | Luce |
| 2,333,386 | A | 11/1943 | Murphy |
| 2,384,729 | A | 9/1945 | Darby |
| 2,421,201 | A | 5/1947 | Hallock |
| 2,421,278 | A | 5/1947 | Luce |
| 2,429,833 | A | 10/1947 | Luce |
| 2,469,311 | A | 5/1949 | Poupitch |
| 2,575,594 | A | 11/1951 | Reiner |
| 2,705,991 | A | 4/1955 | Reiner |

(Continued)

FOREIGN PATENT DOCUMENTS

| | | |
|---|---|---|
| DE | 7411490 | 6/1974 |

(Continued)

*Primary Examiner*—Tulsidas C. Patel
*Assistant Examiner*—Phuongchi Nguyen
(74) *Attorney, Agent, or Firm*—Harness, Dickey & Pierce, P.L.C.

(57) ABSTRACT

The present invention relates to a weld-on fastener for an electrical contact with a weld nut (1) which, on its topside has an electric contact face (9) and, on its bottom side, has an annular axial projection (6) which surrounds a cavity (4) of a pre-determinable depth (T), and with a screw (3) screwed into the weld nut (1), which screw (3) also has an electric contact face (9), a spacer ring (2) being clamped between the contact faces (9). The spacer ring (2) preferably has a thickness (D) which is approximately equal to the depth (T) of the cavity (4). When the spacer ring (2) is clamped in, the screw (3) ends approximately flush with the end of the internal thread (12) of the weld nut (1). This combination is distinctive in that it has only a low overall height, no metal scabs reach the thread (12) during welding-on, the contact faces (9) are protected during assembly and the welded connection can absorb high torques even when welding onto thin work pieces (7).

14 Claims, 1 Drawing Sheet

U.S. PATENT DOCUMENTS

| | | | | |
|---|---|---|---|---|
| 2,707,507 | A | 5/1955 | Tripp et al. | |
| 2,825,380 | A | 3/1958 | Reiner | |
| 2,879,820 | A | 3/1959 | Trzcinski | |
| 2,909,206 | A | 10/1959 | Johnson | |
| 2,936,806 | A | 5/1960 | Harper | |
| 2,968,329 | A | 1/1961 | Reiner | |
| 3,140,738 | A | 7/1964 | Johnson | |
| 3,189,076 | A | 6/1965 | Adams | |
| 3,219,086 | A | 11/1965 | Zahodiakin | |
| 3,259,164 | A | 7/1966 | Hernadi | |
| 3,259,165 | A | 7/1966 | Tobian et al. | |
| 3,322,177 | A | 5/1967 | Phelan | |
| 3,363,084 | A | 1/1968 | Büsing | |
| 3,446,261 | A | 5/1969 | Dey | |
| 3,671,710 | A | 6/1972 | Coombs | |
| 3,695,324 | A | 10/1972 | Gulistan | |
| 3,877,342 | A | 4/1975 | Duchatellier | |
| 4,015,650 | A | 4/1977 | Anderson | |
| 4,193,435 | A | 3/1980 | Charles et al. | |
| 4,377,359 | A | 3/1983 | Peterson | |
| 4,462,710 | A | 7/1984 | Leitner | |
| 4,642,964 | A * | 2/1987 | Kellison | 52/699 |
| 4,652,468 | A | 3/1987 | Gould et al. | |
| 4,701,348 | A | 10/1987 | Neville | |
| 4,762,451 | A | 8/1988 | Collins | |
| 4,798,507 | A | 1/1989 | Olah | |
| 4,828,440 | A | 5/1989 | Anderson et al. | |
| 4,830,557 | A | 5/1989 | Harris et al. | |
| 4,835,819 | A | 6/1989 | Duffy et al. | |
| 4,850,903 | A * | 7/1989 | Guillou et al. | 439/784 |
| 4,856,954 | A | 8/1989 | Peterson | |
| 4,875,816 | A | 10/1989 | Peterson | |
| 4,875,817 | A | 10/1989 | Suzumura et al. | |
| 4,911,591 | A | 3/1990 | Oaks | |
| 4,984,319 | A | 1/1991 | Reynolds | |
| 4,990,109 | A * | 2/1991 | Romerein et al. | 439/801 |
| 5,022,804 | A | 6/1991 | Peterson | |
| RE33,766 | E | 12/1991 | Duffy et al. | |
| 5,096,349 | A | 3/1992 | Landy et al. | |
| 5,096,350 | A | 3/1992 | Peterson | |
| 5,137,406 | A | 8/1992 | Cosenza | |
| 5,146,668 | A | 9/1992 | Gulistan | |
| 5,193,643 | A | 3/1993 | McIntyre | |
| 5,221,170 | A | 6/1993 | Duffy et al. | |
| 5,405,228 | A | 4/1995 | Reid et al. | |
| 5,423,646 | A | 6/1995 | Gagnon | |
| 5,492,388 | A * | 2/1996 | Kawasaki | 296/193.02 |
| 5,542,158 | A | 8/1996 | Gronau et al. | |
| 5,605,353 | A | 2/1997 | Moss et al. | |
| 5,624,319 | A | 4/1997 | Golczyk et al. | |
| 5,630,686 | A | 5/1997 | Billmann | |
| 5,655,865 | A | 8/1997 | Plank et al. | |
| 5,655,931 | A * | 8/1997 | Perugini | 439/573 |
| 5,679,160 | A | 10/1997 | Wallace et al. | |
| 5,750,190 | A | 5/1998 | Woodhall et al. | |
| 5,918,727 | A | 7/1999 | Wallace et al. | |
| 5,928,711 | A | 7/1999 | Wallace et al. | |
| 5,961,264 | A | 10/1999 | Postadan | |
| 6,027,568 | A | 2/2000 | Wallace et al. | |
| RE36,681 | E | 5/2000 | Rindeer | |
| 6,109,849 | A | 8/2000 | Nagayama | |
| 6,141,837 | A | 11/2000 | Wisniewski | |
| 6,146,071 | A | 11/2000 | Norkus et al. | |
| 6,183,180 | B1 | 2/2001 | Copple et al. | |
| 6,234,850 | B1 * | 5/2001 | Pandit et al. | 439/801 |
| 6,287,064 | B1 | 9/2001 | Jhumra et al. | |
| 6,302,628 | B1 | 10/2001 | Berecz et al. | |
| 6,357,980 | B1 | 3/2002 | Lansinger | |
| 6,433,278 | B1 | 8/2002 | Blank et al. | |
| 6,450,747 | B1 | 9/2002 | Fischer | |
| 6,535,394 | B1 * | 3/2003 | Hirzmann | 361/761 |
| 6,575,680 | B1 | 6/2003 | Herb et al. | |
| 6,623,214 | B1 * | 9/2003 | Hauske et al. | 405/302.7 |
| 6,637,994 | B1 | 10/2003 | Leistner | |
| 6,679,666 | B1 * | 1/2004 | Mizuno et al. | 411/353 |
| 6,746,285 | B1 * | 6/2004 | Delcourt et al. | 439/766 |
| 6,776,566 | B1 * | 8/2004 | Kobusch et al. | 411/546 |
| 6,827,537 | B1 * | 12/2004 | Norman et al. | 411/171 |
| 2002/0182027 | A1 | 12/2002 | Gauron | |
| 2003/0202856 | A1 | 10/2003 | Nilsen et al. | |

FOREIGN PATENT DOCUMENTS

| | | |
|---|---|---|
| DE | 7907821 | 7/1979 |
| DE | 3728219 | 3/1989 |
| DE | 9408041 | 8/1994 |
| DE | 4417397 | 11/1995 |
| DE | 4432550 | 11/1995 |
| DE | 29518398 | 3/1996 |
| DE | 19637935 | 4/1998 |
| DE | 19811532 | 9/1999 |
| EP | 0405025 | 1/1991 |
| EP | 1060826 | 12/2000 |
| EP | 1116890 | 7/2001 |
| EP | 1202616 | 5/2002 |
| GB | 2041138 | 9/1980 |
| WO | WO 97/35684 | 10/1997 |
| WO | WO 01/76811 | 10/2001 |
| WO | WO 03/038293 | 5/2003 |

* cited by examiner

FASTENER FOR AN ELECTRIC CONTACT

CROSS-REFERENCE TO RELATED APPLICATIONS

This application is a continuation of International Application No. PCT/DE02/00490, filed Feb. 12, 2002, which claims priority to German Patent Application DE 101 07 231.7, filed Feb. 16, 2001. The disclosure of the above applications are incorporated herein by reference.

FIELD OF THE INVENTION

The invention relates to a weld-on fastener for an electric contact, in particular for an earth terminal.

BACKGROUND OF THE INVENTION

Weld-on fasteners are used, for example, in automotive engineering, where they are used for producing an electric earth contact. It is known from EP 0 640 404 how an electric contact of this type is fastened to a metal sheet. To avoid soiling of the electric contact faces, a protective cap is applied to a stud provided with a thread. This stud with protective cap is then connected to the metal sheet by welding. The protective cap has, in particular, the task of protecting the thread of the stud from subsequent soiling, in particular paint which, when attaching the screws for a cable, would prevent an electric contact.

On the one hand, known earth studs of this type have a relatively high overall height, which is not always desirable. On the other hand, it is difficult to carry out the welding of known earth studs to metal sheets less than 0.6 mm thick. Furthermore, the connections produced can only absorb limited torques, in particular after welding to thin structures.

It is therefore the object of the invention to overcome the mentioned drawbacks and provide a weld-on fastener which allows secure attachment of an electrical contact with low overall height.

SUMMARY OF THE INVENTION

This object is achieved by the features of claim 1. Further advantageous configurations of the invention are the subject of the dependent claims.

The weld-on fastener according to the invention for an electric contact comprises a weld nut which, on its topside, has an electric contact face and, on its bottom side, has an annular axial projection which surrounds a cavity of predeterminable depth, and with a screw screwed into the weld nut, which screw also has an electric contact face, a spacer ring being clamped between the contact faces. The nut, spacer ring and screw are handled, assembled as a unit and welded on. By welding the annular projection of the weld nut to a metal sheet, a larger external diameter of the welded connection is achieved in contrast to a comparably large conventional weld nut, so absorption of higher torques is achieved. The electric contact faces between screw and weld nut are protected from soiling with the aid of the clamped-in spacer ring. The contact faces therefore remain clean during transportation, during handling and during the welding process and later painting processes. A good quality electric contact can then be produced later by screwing off the screw, removing the spacer ring, applying a contact ring and re-screwing the screw tightly. A higher torque can be absorbed owing to the large diameter of the weld nut in contrast to a conventional weld nut which has smaller diameter as a rule. In addition, welds are possible herewith with smaller sheet metal thicknesses, i.e. less than 0.6 mm. Welding a nut with an annular projection, shapes and measurements suitable for this, and the requisite equipment are generally known in the state of the art.

A contact produced in this way is preferably an earth contact for voltages between 6 and 42 volts, in particular in a motor vehicle. The present invention is particularly suitable for applications of this type in mass production.

In a preferred embodiment of the invention, the spacer ring is made of elastic material, in particular polyethylene. A secure hold of the parts to one another can be achieved, therefore, in pre-assembly.

In a particular development of the invention, the spacer ring protects as a seal against wetting by paint and other soiling. This function is important if the workpiece, for example, receives one or more coats of paint before a contact ring is attached.

In a particularly advantageous development of the invention, the spacer ring has a thickness which is approximately equal to the depth of the cavity in the welded state. This is particularly significant in conjunction with a further preferred embodiment of the invention according to which the end of the screw ends approximately flush with the end of the internal thread of the weld nut when the spacer ring is clamped. This means that during welding, neither the external thread of the screw nor the internal thread of the weld nut can be soiled by metal scabs. The screw can, therefore, later be easily screwed off and on again. After removal of the spacer ring and attachment of a contact ring, the screw cannot strike against the workpiece even when screwed completely tight, when the spacer ring is the above-mentioned size, as the end of the screw can project into the cavity by a maximum excess length corresponding to the thickness of the spacer ring minus the thickness of the contact ring. The given coordination of the measurements of all the parts with one another is therefore particularly advantageous for the present invention.

Finally, it is also favorable to make the external diameter of the annular projection larger than the external diameter of the other fastener. This allows adaptation to different work piece thicknesses and desired torques without changing the sizes of the contact faces.

Further special embodiments and advantages of the invention are described in the following drawings. Without limiting the invention, the drawings show one of many possible embodiments, in which drawings:

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment is merely exemplary in nature and is in no way intended to limit the invention, its application, or uses.

Figure 1:
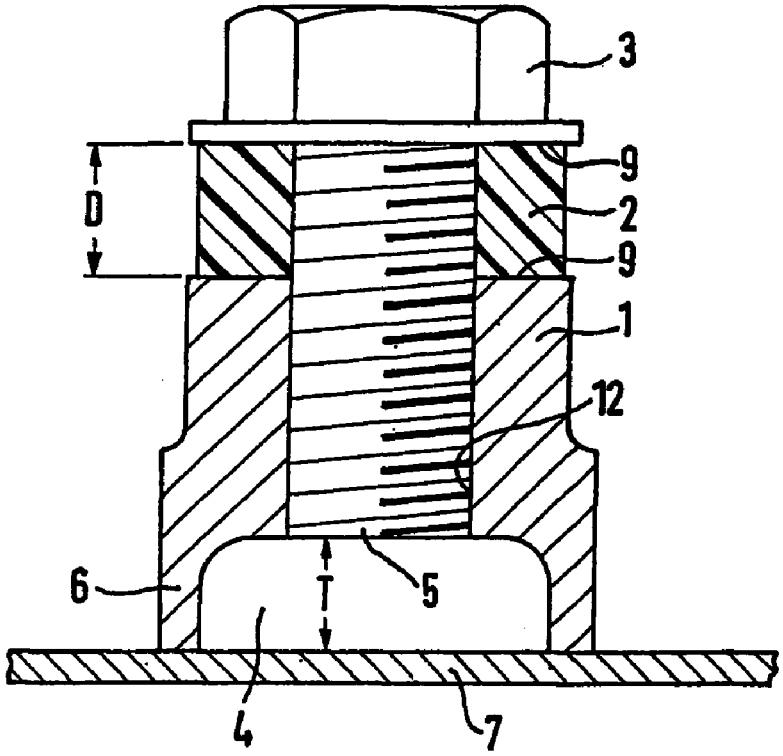
FIG. 1 is a longitudinal sectional view of a weld-on fastener according to the invention.

FIG. 1 shows a weld-on fastener according to the invention for an electric contact. It comprises a weld nut 1 which, on its topside has an electric contact face 9 and, on its bottom side, has an annular axial projection 6 which surrounds a cavity 4 of a pre-determinable depth T, and with a screw 3 screwed into the weld nut 1, which screw also has an electric contact face 9, a spacer ring 2 being clamped between the contact faces 9. The spacer ring 2 is formed in such a way that it substantially covers the contact faces 9 and is securely clamped in between them. Owing to the clamping of the spacer ring 2, the screw 3 and weld nut 1 are braced against one another, so detaching the screw 3 from the weld nut 1 is prevented even under high mechanical loading (for example by vibrations during transportation or handling) due to comparatively high static friction. The spacer ring 2 seals the screw 3 from the weld nut 1 and prevents impurities and paint from penetrating to the contact faces and into the interior of the pre-assembled combination. The end 5 of the screw 3 with the external thread 13 ends flush with the end of the interior thread 12 of the weld nut 1. When welding onto the work piece 7 which can consist of a thin metal sheet, for example less than 0.6 mm thick, no metal scabs can therefore deposit in the threads and later impede disassembly or assembly. The thickness D of the spacer ring 2 is advantageously approximately as large as the depth T of the cavity 4. The screw can therefore later strike against an electric contact ring and not against the workpiece 7 when the spacer ring 2 is replaced.

Figure 2:
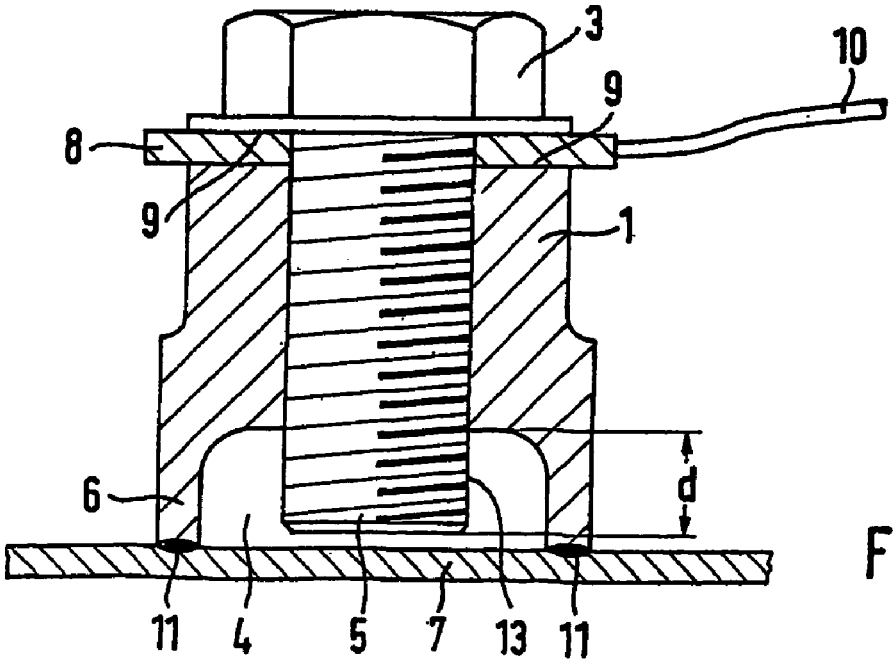
FIG. 2 is a sectional view showing the welded-on fastener according to FIG. 1, in which the spacer ring has been removed and an electric line fastened.

FIG. 2 shows the completely assembled fastener according to the invention in FIG. 1, in which an electric line 10 is clamped with a contact ring 8 instead of the spacer ring 2 between the contact faces 9 of the screw 3 and weld nut 1. Relatively high currents can be conducted and high torques absorbed via the annular welded connection 11. The screwed-in screw 3 reaches a maximum excess length d into the cavity 4 with its end 5, which cavity 4 corresponds to the thickness D of the earlier spacer ring 2 minus the thickness of the contact ring 8 and therefore cannot touch the work piece 7 and therefore cannot damage the welded connection 11, if the spacer ring 2 previously had a thickness D approximately like the depth T of the cavity 4.

The invention is particularly suitable for application in mass production, in which automatic tools are worked with. The pre-assembled unit of weld nut, spacer ring and screw can be handled and welded like other welding parts and is suitable for welding to thin metal sheets, for contacts with low overall height and high load.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A weld-on fastener for an electric contact with a weld nut, the fastener comprising:

a weld nut including:

(i) a body defining a threaded bore;

(ii) the body having a topside having a first electric contact face; and (iii) a bottom side having an annular axial weldment projection surrounding a cavity, the cavity having a predeterminable depth;

a screw fastenably connectable into the weld nut, the screw having a second electric contact face; and a removable spacer ring operably clamped between and in contact with the first and second contact faces to inhibit the infusion of a coating onto the first and second contact faces, the spacer ring removable to enable an electrical contact to be coupled to the body.

2. The fastener according to claim 1, wherein the first and second electric contact faces together comprise a grounding terminal useable in a motor vehicle.

3. The fastener according to claim 1, wherein the spacer ring comprises an elastic material, the elastic material including polyethylene.

4. The fastener according to claim 1, wherein the spacer ring comprises a seal operably sealing the contact faces against one of dirt and paint.

5. The fastener according to claim 1, wherein the spacer ring comprises a pre-determinable thickness substantially equal to the depth of the cavity in a fastener welded state to enable the screw to fully threadably engage the weld nut prior to the screw contacting a work piece after the removal of the spacer ring.

6. The fastener according to claim 1, comprising:

the weld nut defining an internally thread bore having an internal thread length, said weld nut having an annular weldment area which defines a non-threaded cavity; and the screw including an external thread having an external thread length, wherein the external thread length is dimensionable such that a screw end is locatable substantially flush with an internal thread end of the weld nut when the spacer ring is clamped.

7. The fastener according to claim 1, wherein an external cross sectional width of the annular axial projection is larger than a topside cross sectional width.

8. A weld-on fastener system, comprising:

a weld nut including:

(i) a first end having a flat surface forming a first electric contact face;

(ii) a second end defining a cavity formed by an annular axial weldment projection and a weldable joint formable at a distal end of the annular axial weldment projection; and (iii) a longitudinal, female threaded aperture formable between the electric contact face and the cavity;

a screw having a male thread engageable with the female threaded aperture of the weld nut, and a head forming a second electric contact; and a spacer ring positionable between the first and second electric contacts when the screw is engaged within the female threaded aperture, the spacer ring substantially covering both the first and second electric contacts, the spacer acting to seal the first and second electric contacts.

9. The system of claim 8, comprising a cavity depth measurable from the second end.

10. The system of claim 9, wherein the spacer ring comprises a thickness substantially equal to the cavity depth to enable the screw to fully threadably engage the weld nut prior to the screw contacting a work piece after the removal of the spacer ring.

11. A method for forming a weld-on fastener, the weld-on fastener including a weld nut having a first electric contact face and a cavity formable at an opposed end of the weld nut from the first electric contact face, the method comprising:

extending a female aperture through the weld nut;

defining a non-threaded cavity co-axial with the aperture;

threading the aperture;

positioning a spacer ring in contact with the first electric contact face;

inserting a male threaded screw a first time through the spacer ring until the screw threadably engages with the female threaded aperture;

fastenably engaging the screw into the weld nut until both a second electric contact face of the screw and the first electric contact face of the weld nut oppositely seat with the spacer ring;

welding the weld nut to a surface:

applying paint to the weld nut;

removing the spacer ring after the application of paint to the weld nut; and threadably engaging the screw with the female aperture a second time.

12. The method of claim 11, comprising forming an annular axial projection about the cavity.

13. The method of claim 11, comprising controlling a thickness of the spacer ring to substantially equal a depth of the cavity.

14. The method according to claim 11, further comprising disposing an electrical contact between the first and second electric contact faces after the removal of the spacer ring.

* * * * *